US008424993B2

(12) United States Patent
Ikehata et al.

(10) Patent No.: US 8,424,993 B2
(45) Date of Patent: Apr. 23, 2013

(54) INK JET TYPE RECORDING DEVICE AND COMPUTER PROGRAM

(75) Inventors: Katsuo Ikehata, Hamamatsu (JP); Koji Takahashi, Hamamatsu (JP); Tadakazu Otsuka, Hamamatsu (JP); Fumiyoshi Yoshizawa, Hamamatsu (JP)

(73) Assignee: Roland DG Corporation, Hamamatsu-Shi (JP)

( * ) Notice: Subject to any disclaimer, the term of this patent is extended or adjusted under 35 U.S.C. 154(b) by 255 days.

(21) Appl. No.: 13/060,265

(22) PCT Filed: Aug. 21, 2009

(86) PCT No.: PCT/JP2009/064655

§ 371 (c)(1),
(2), (4) Date: Feb. 22, 2011

(87) PCT Pub. No.: WO2010/021377

PCT Pub. Date: Feb. 25, 2010

(65) Prior Publication Data

US 2011/0157272 A1 Jun. 30, 2011

(30) Foreign Application Priority Data

Aug. 21, 2008 (JP) ..... 2008-213397

(51) Int. Cl.
*B41J 29/38* (2006.01)
*B41J 2/01* (2006.01)

(52) U.S. Cl.
USPC ..... 347/16; 347/9; 347/101; 347/102

(58) Field of Classification Search ..... 347/9, 16, 347/101–102
See application file for complete search history.

(56) References Cited

U.S. PATENT DOCUMENTS

2004/0141042 A1* 7/2004 Silverbrook ..... 347/102
2009/0244126 A1* 10/2009 Okamori ..... 347/9

* cited by examiner

*Primary Examiner* — Jason Uhlenhake
(74) *Attorney, Agent, or Firm* — Lee, Hong, Degerman, Kang & Waimey

(57) ABSTRACT

In accordance with an embodiment, an inkjet recording apparatus is presented. The inkjet apparatus includes a recording head configured to eject an ink on a recording medium, an ink curing device configured to cure the ink ejected on the recording medium, a moving device configured to move the recording medium in a first direction and a second direction opposite to the first direction, a control device configured to control the recording head, the ink curing device, and the moving device.

14 Claims, 8 Drawing Sheets

INK JET TYPE RECORDING DEVICE AND COMPUTER PROGRAM

CROSS-REFERENCE TO RELATED APPLICATIONS

This application is the National Stage filing under 35 U.S.C. 371 of International Application No. PCT/JP2009/064655, filed on Aug. 21, 2009, which claims the benefit of earlier filing date and right of priority to Japanese Patent Application No. 2008-213397, filed on Aug. 21, 2008, the contents of which are all hereby incorporated by reference herein in their entirety.

BACKGROUND OF THE INVENTION

1. Field of the Invention

The present invention relates to an inkjet recording apparatus, and a computer program for controlling the inkjet recording apparatus.

2. Discussion of the Related Art

Conventionally, an inkjet recording apparatus forms a flat image on a recording medium. Recent inkjet recording apparatuses may form layers of ink cured via ultraviolet rays (hereinafter referred to as "hardened layers") to form a three-dimensional image.

The inkjet recording apparatus ejects ultraviolet curable ink and emits ultraviolet rays while moving a recording head. Additionally, the inkjet recording apparatus moves the recording medium forward by a prescribed feed amount each time the recording head moves in a particular direction. Accordingly, the aforementioned process forms one hardened layer on the recording medium. The recording medium is retracted backward after one hardened layer is formed. Then, a new hardened layer is formed on the previous hardened layer in a similar manner. The procedure is repeated until a prescribed number of hardened layers are formed.

In the example above, the recording medium is moved forward by a prescribed feed amount each time the recording head moves laterally. Accordingly, the process for forming a three-dimensional image is very time consuming. Additionally, the feeding and retraction of the recording medium may lead to errors in positioning of the hardened layers. Furthermore, dust in the ambient air tends to adhere to the already formed hardened layer before the next hardened layer is formed, thereby lowering the quality of the three-dimensional image.

The present invention cures the aforementioned defects. Therefore, an object of the present invention is to provide an inkjet recording apparatus which can quickly form a high-quality three-dimensional image.

SUMMARY OF THE INVENTION

Features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

In accordance with an embodiment, an inkjet recording apparatus is presented. The inkjet apparatus includes a recording head configured to eject an ink on a recording medium, an ink curing device configured to cure the ink ejected on the recording medium, a moving device configured to move the recording medium in a first direction and a second direction opposite to the first direction, a control device configured to control the recording head, the ink curing device, and the moving device, the control device including a first control part configured to perform a first printing operation comprising ejecting the ink from the recording head while moving the recording medium in the first direction, curing the ink ejected from the recording head before a prescribed period of time, and repeating the ejecting and curing of the ink such that the ink can be ejected on the cured ejected ink, a second control part configured to control movement of the recording medium in the second direction after the completion of the first printing operation, and a third control part configured to perform, after the recording medium has been moved in the second direction, a second printing operation comprising ejecting and curing the ink on the cured ink from the first printing operation, after the prescribed period of time.

According to one feature, the first control part and the third control part control the recording head such that the first printing operation forms a layer of the ink which is thicker than a layer of the ink formed by the second printing operation. Additionally, the first control part and the third control part control the moving device such that the recording medium is moved by a feed amount during the first operation which is less than a feed amount of the second printing operation.

According to another feature, the first control part and the third control part control the moving device and the recording head such that the second printing operation forms a print area on the recording medium which is greater than a print area of the first printing operation. Furthermore, the ink cures upon exposure to ultraviolet rays, and the ink curing device emits the ultraviolet rays.

According to yet another feature, the first control part and the third control part control the emitting device such that the period of time before the ink is irradiated with ultraviolet rays after the ink has been ejected is greater in the second printing operation in comparison to the first printing operation.

According to still yet another feature, the first control part and the third control part control the recording head such that the number of times the ink is ejected and cured per a prescribed feed amount by which the recording medium is moved is greater in the first printing operation in comparison to the second printing operation.

According to another feature, the ink is a clear ink. Furthermore, the inkjet apparatus further includes an additional recording head for ejecting a chromatic color ink, wherein the control device forms an image on the recording medium by ejecting the chromatic color ink onto the recording medium from the additional recording head prior to the first printing operation, and wherein the first control part controls the clear ink to be ejected over the formed image.

According to still yet another feature, the inkjet recording apparatus further includes a guide rail extending perpendicular to the first direction, and a moving mechanism for moving the recording head along the guide rail, wherein the first control part and the third control part instruct the recording head to eject the ink without moving the recording medium while moving the recording head in the first printing operation and the second printing operation.

According to yet another feature, the inkjet recording apparatus further includes a guide rail extending in a scanning direction perpendicular to the first direction, and a moving mechanism for moving the recording head along the guide rail, wherein the ink curing device has a first curing device disposed on one side of the recording head and movable with the recording head, and a second curing device disposed on a side opposite the one side of the first curing device, offset in the first direction with respect to the recording head, and movable with the recording head.

According to another feature the first control part performs the first printing operation such that the ink has a concave shape when cured.

According to another embodiment, inkjet recording apparatus configured to print in a first print mode, a second print mode, and a third print mode is presented. The inkjet recording apparatus includes a recording head configured to eject an ink on a recording medium, an ink curing device configured to cure the ink ejected on the recording medium, a moving device configured to move the recording medium in a first direction and a second direction opposite to the first direction, a control device for controlling the recording head, the ink curing device, and the moving device, the control device including a first control part configured to perform a first printing operation comprising ejecting the ink from the recording head while moving the recording medium in the first direction, and curing the ink ejected from the recording head before a prescribed period of time, and a second control part configured to perform a second printing operation comprising ejecting the ink from the recording head while moving the recording medium in the first direction, and curing the ink ejected from the recording head after the prescribed period of time, wherein the first control part performs the first printing operation when the first print mode is selected, wherein the second control part performs the second printing operation when the second print mode is selected, and wherein after the first control part has performed the first printing operation and the second control part has performed the second printing operation, the recording medium is moved in the second direction when the third print mode is selected.

According to yet another embodiment, an inkjet apparatus is presented. The inkjet apparatus includes, a recording head configured to eject an ink on a recording medium, an ink curing device configured to cure the ink ejected on the recording medium, a moving device configured to move the recording medium in a first direction and a second direction opposite to the first direction, a computer configured to control the recording head, the ink curing device, and the moving device, wherein a computer program configured to control the computer of the inkjet recording apparatus includes a first control means configured to perform a first printing operation comprising ejecting the ink from the recording head while moving the recording medium in the first direction, and curing the ink ejected from the recording head before a prescribed period of time, a second control means configured to control movement of the recording medium in the second direction after the completion of the first printing operation, and a third control means configured to perform, after the recording medium has been moved in the second direction, a second printing operation comprising ejecting and curing the ink on the cured ink from the first printing operation, after the prescribed period of time.

According to still yet another embodiment an inkjet apparatus is presented. The inkjet apparatus includes a recording head configured to eject an ink on a recording medium, an ink curing device configured to cure the ink ejected on the recording medium, a moving device configured to move the recording medium in a first direction and a second direction opposite to the first direction, and a control device configured to control the recording head, the ink curing device, and the moving device, the control device includes a first control part configured to perform a first printing operation comprising ejecting and curing the ink while moving the recording medium in the first direction, a second control part configured to control movement of the recording medium in the second direction after the completion of the first printing operation, and a third control part configured to perform, after the recording medium has been moved in the second direction, a second printing operation comprising curing and ejecting the ink on the cured ink of the first printing operation.

According to another embodiment, an inkjet recording apparatus capable of performing printing in a first print mode, a second print mode, and a third print mode, is presented. The inkjet recording apparatus includes a recording head configured to eject an ink on a recording medium, an ink curing device configured to cure the ink ejected on the recording medium, a moving device configured to move the recording medium in a first direction and a second direction opposite to the first direction, a control device configured to control the recording head, the ink curing device, and the moving device, the control device includes a first control part configured to perform a first printing operation comprising ejecting and curing the ink while moving the recording medium in the first direction, a second control part configured to perform a second printing operation comprising ejecting and curing the ink while moving the recording medium in the first direction, wherein the first control part performs the first printing operation when the first print mode is selected, wherein the second control part performs the second printing operation when the second print mode is selected, and wherein after the first control part has performed the first printing operation and the second control part has performed the second printing operation the recording medium is moved in the second direction when the third print mode is selected.

These and other embodiments will also become readily apparent to those skilled in the art from the following detailed description of the embodiments having reference to the attached figures, the invention not being limited to any particular embodiment disclosed.

BRIEF DESCRIPTION OF THE DRAWINGS

The above and other aspects, features, and advantages of the present invention will become more apparent upon consideration of the following description of preferred embodiments, taken in conjunction with the accompanying drawing figures.

DETAILED DESCRIPTION OF THE PREFERRED EMBODIMENTS

In the following detailed description, reference is made to the accompanying drawing figures which form a part hereof, and which show by way of illustration specific embodiments of the invention. It is to be understood by those of ordinary skill in this technological field that other embodiments may be utilized, and structural, electrical, as well as procedural changes may be made without departing from the scope of the present invention. Wherever possible, the same reference numbers will be used throughout the drawings to refer to the same or similar parts.

Figure 1:
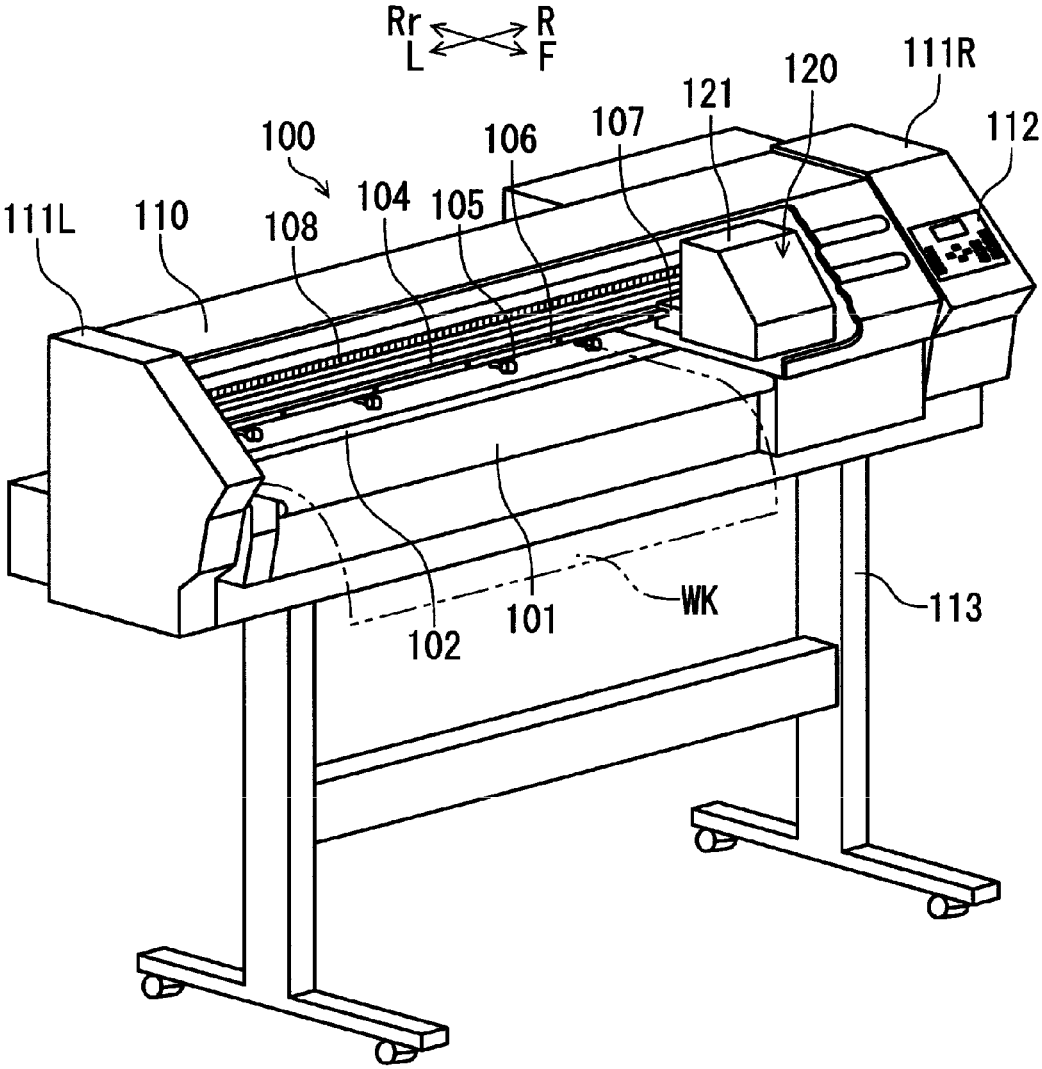
FIG. 1 is an illustration of an inkjet printer according to an embodiment of the present invention.
Figure 2:
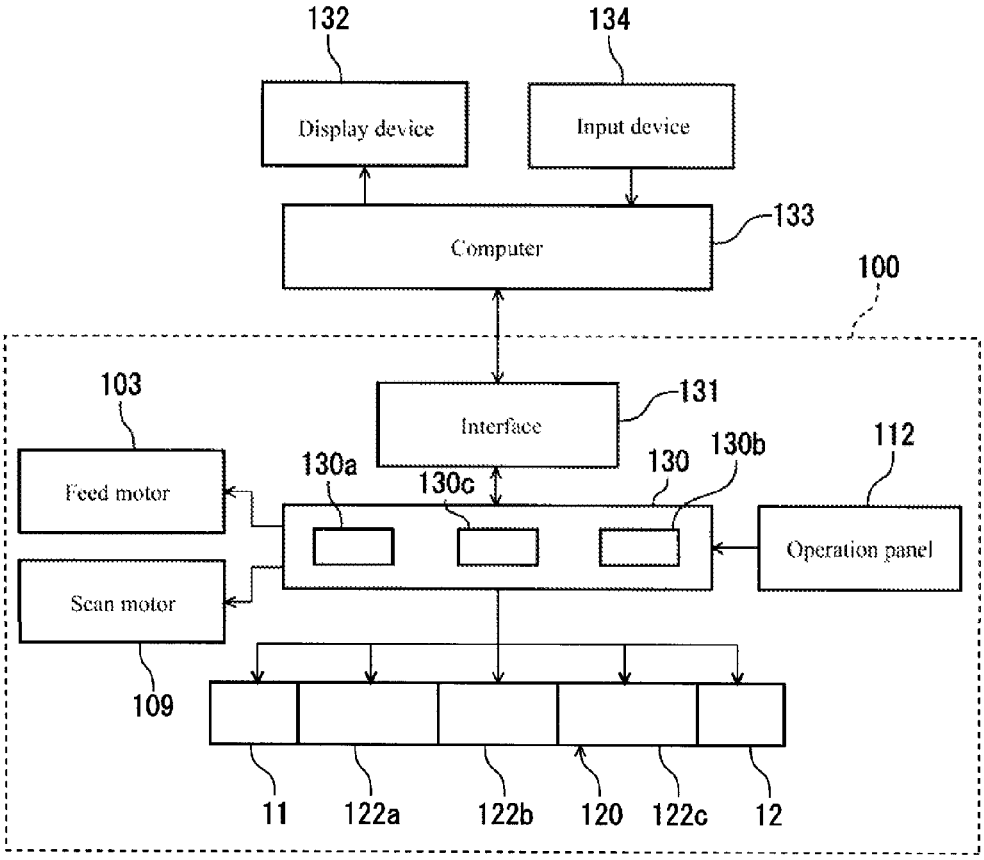
FIG. 2 is a block diagram of a control system for the inkjet printer according to an embodiment of the present invention.

Description is hereinafter made with regard to an inkjet printer 100 as an embodiment of an inkjet recording apparatus of the present invention. FIG. 1 is an illustration of the inkjet printer 100. FIG. 2 is a block diagram of a control system for the inkjet printer 100 according to an embodiment of the present invention.

The inkjet printer 100 is a device for printing on a surface of a recording medium WK. The recording medium WK may be a flexible sheet-like medium or a hard recording medium, such as a glass substrate. The inkjet printer 100 can form a printed surface which bulges out from the surface of the recording medium WK, in other words, the inkjet printer 100 can perform three-dimensional printing.

As illustrated in FIG. 1, the inkjet printer 100 includes a platen 101. The recording medium WK is placed on the platen 101 and the platen 101 may extend laterally. A cylindrical grid roller 102 is provided on the platen 101. The grid roller 102 is driven by a feed motor 103 (FIG. 2).

A guide rail 104 is provided above the platen 101. The guide rail 104 is disposed parallel to the platen 101 and extends laterally. Four pinch rollers 105 are provided at intervals below the guide rail 104. The pinch rollers 105 are opposed to the grid roller 102. The grid roller 102 and the pinch rollers 105 pinch the recording medium WK and convey the recording medium WK in the front-rear direction. In the following example, the front-rear direction is referred to as a "sub-scanning direction," and the lateral direction is referred to as a "main scanning direction." The sub-scanning direction is the direction in which the recording medium WK is moved, and the main scanning direction is the direction in which a recording head unit 120 moves.

The symbols F, Rr, R, L illustrated in FIG. 1 represent front, rear, right, and left, respectively. In this embodiment, the main scanning direction is the lateral direction, and the sub-scanning direction is the front-rear direction. However, the main scanning direction and the sub-scanning direction are not limited to the aforementioned directions.

The guide rail 104 has an engaging portion 106 protruding forward. A block 107 is secured to a back surface of a case 121 of the recording head unit 120. The engaging portion 106 of the guide rail 104 is engaged with the block 107, such that the block 107 is slidable along the guide rail 104. The recording head unit 120 is guided laterally along the guide rail 104.

A part of a driving belt 108 extends laterally and is secured to an upper part of the back surface of the case 121. The driving belt 108 is connected to a scan motor 109 (FIG. 2). The driving belt 108 is driven by the scan motor 109. The recording head unit 120 is driven by the scan motor 109 via the driving belt 108.

FIG. 1 illustrates a state where the recording head unit 120 is in its home position. The home position refers to the origin position of the recording head unit 120. During the initial activation of the inkjet printer 100 or when printing is not performed on the recording medium WK, the recording head unit 120 waits at the home position.

An upper cover 110 is provided above the recording head unit 120. The upper cover 110 forms an upper housing of the inkjet printer 100. On both sides of the platen 101 and the upper cover 110, side covers 111R and 111L are provided. The side covers 111R and 111L form right and left housings, respectively, of the inkjet printer 100. An operation panel 112 is provided on a front surface of the side cover 111R. The operation panel 112 includes input devices such as buttons and switches. The user can input instructions using the operation panel 112. The operation panel 112 also includes a display device for displaying information. A stand 113 is provided under the platen 101.

Figure 3:
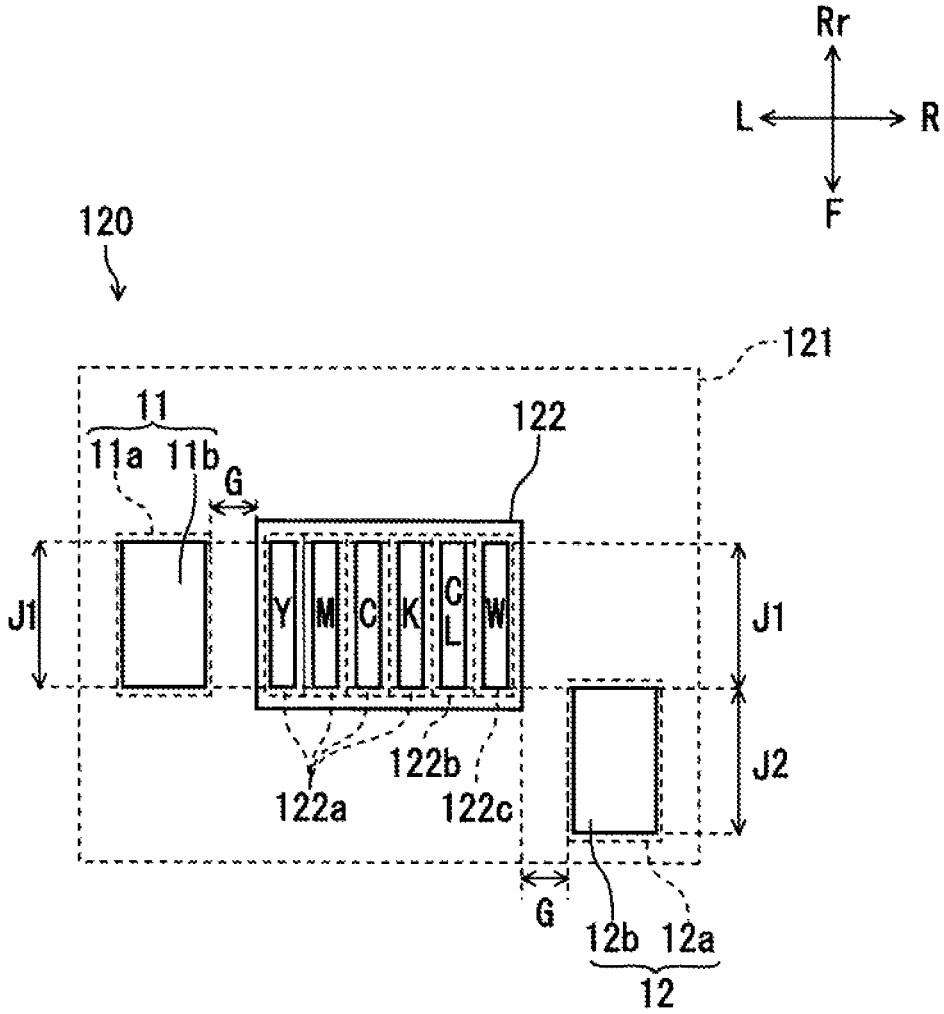
FIG. 3 illustrates the configuration of a recording head unit according to an embodiment of the present invention.

As illustrated in FIG. 3, the recording head unit 120 is provided with four recording heads 122*a* for ejecting yellow (Y), magenta (M), cyan (C), and black (K) inks, a recording head 122*b* for ejecting clear (CL)ink, and a recording head 122*c* for ejecting white (W) ink. The recording heads 122*a*, the recording head 122*b*, and the recording head 122*c* are arranged laterally. In the following example, the group of the recording heads 122*a*, 122*b*, and 122*c* are referred to as the recording head group 122. A plurality of nozzles arranged longitudinally are formed in a lower surface of each of the recording heads 122*a*, 122*b*, and 122*c* (not shown). The length J1 represents the longitudinal length of the nozzle array. Yellow, magenta, cyan, and black are chromatic colors, which are necessary to form a color image, and are referred to as process color inks In this embodiment, each of the inks cures upon exposure to ultraviolet rays.

The recording head unit 120 is provided with a first emitting device 11 and a second emitting device 12 for emitting ultraviolet rays. The first emitting device 11 comprises a case 11*a* and an emitter 11*b* disposed in the case 11*a*. The second emitting device 12 comprises a case 12*a* and an emitter 12*b* disposed in the case 12*a*. The areas covered by the emitters 11*b* and 12*b* are equal to the areas in which ultraviolet rays are emitted. In this embodiment, the emitters 11*b* and 12*b* are light-emitting diodes which emit ultraviolet rays. However, the emitters 11*b* and 12*b* are not limited to light-emitting diodes and may be other types of light emitters such as halogen lamps.

The first emitting device 11 is located on the left side of the recording head group 122. The first emitting device 11 is located on the same scanning plane as the recording head group 122. The emitter 11*b* has a longitudinal length which is equal to the longitudinal length J1 of the nozzle array of each of the recording heads 122*a*, 122*b*, and 122*c*. The emitter 11*b* and the recording head group 122 are laterally aligned with each other. The second emitting device 12 is located on the right side and in front of the recording head group 122, in other words, the second emitting device 12 is offset from the recording head group 122. The emitter 12*b* has a longitudinal length J2 which is equal to the longitudinal length J1 of the nozzle array of each of the recording heads 122*a*, 122*b*, and 122*c*. In this embodiment, the distance between the rear end of the emitter 12*b* and the front end of the recording head group 122 is zero. However, the distance is not limited to being zero. The emitter 12*b* is offset by one scanning line with respect to the recording head group 122. The distance between the first emitting device 11 and the recording head group 122, and the distance between the second emitting device 12 and the recording head group 122 are the same distance G. However, the aforementioned distances, represented by the distance G may be different from each other.

The case 121 of the recording head unit 120 supports the recording head group 122, the first emitting device 11, and the second emitting device 12. However, the first emitting device 11 and the second emitting device 12 may be located outside the case 121. The recording head group 122 may be disposed in the case 121 with the first emitting device 11, while the second emitting device 12 may be located outside the case 121 and secured to the case 121 via a coupling member (not shown).

A controller 130, illustrated in FIG. 2, may include a microcomputer including a CPU, a ROM, and a RAM. The controller 130 can control various operations of the inkjet printer 100. The controller 130 is provided with a first control part 130*a* for performing a first printing operation, a second control part 130*b* for performing a second printing operation, and a third control part 130*c*. The controller 130 may be connected to an external computer 133 via an interface 131. The computer 133 may be, for example, a personal computer connected to an input device 134 such as a keyboard or mouse and may include a display device 132 for displaying information. The controller 130 can also control various operations according to instructions from the computer 133. The controller 130 executes a computer program stored in a storage device, such as a ROM, to control the feed motor 103, the scan motor 109, the recording heads 122*a*, the recording head 122*b*, the recording head 122*c*, the first emitting device 11, and the second emitting device 12.

In this embodiment, the controller 130 of the inkjet printer 100 includes the first control part 130*a*, the second control part 130*b*, and the third control part 130*c*. However, at least one of the first control part 130*a*, the second control part 130*b*, and the third control part 130*c* may be included in the external computer 133. Also, the first control part 130*a*, the second control part 130*b*, and the third control part 130*c* may be implemented by software or hardware. The first control part 130*a*, the second control part 130*b*, and the third control part 130*c* may be integrated with each other or be distinct components. In other words, a prescribed section of the controller 130 may be configured to fulfill all the functions of the first control part 130*a*, the second control part 130*b*, and the third control part 130*c*, for example.

The operation of the inkjet printer 100 will now be described. First, the user turns on the power supplies of the inkjet printer 100 and the computer 133. Next, the user instructs the computer 133 to execute a prescribed program and the inkjet printer 100 may then execute a program stored in the ROM of the controller 130. The controller 130 then waits for a command from the computer 133.

The user inserts the recording medium WK between the grid roller 102 and the pinch rollers 105 to set the recording medium WK on the platen 101. Next, the user operates the input device 134 to instruct the inkjet printer 100, via the computer 133, to perform printing. Prior to this, the user may have stored image data to be printed in the computer 133. The data may be data that was created by the user via the computer 133 or data created separately and stored in the computer 133.

Figure 4:
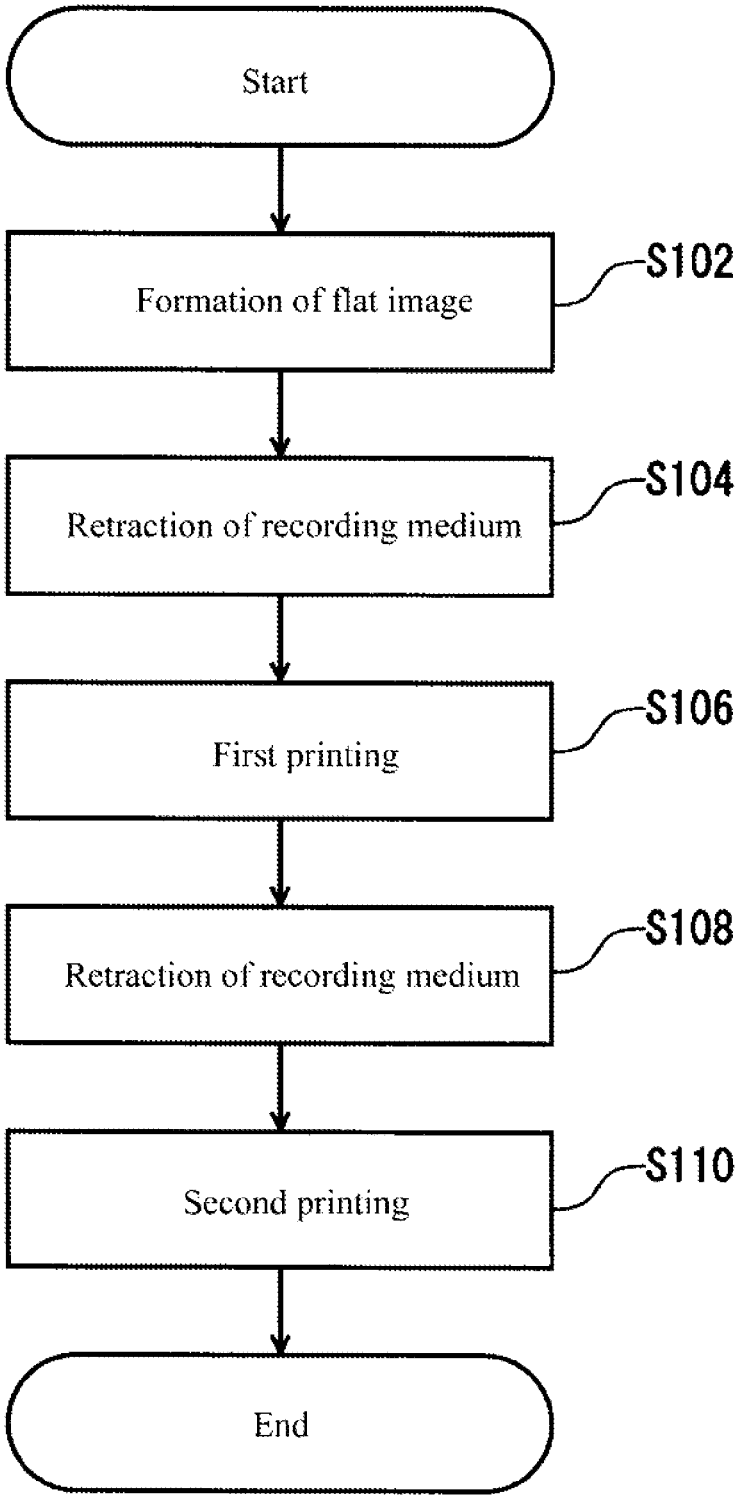
FIG. 4 is a flowchart of an inkjet printer according to an embodiment of the present invention.

FIG. 4 illustrates an example of the three-dimensional printing according to an embodiment of the present invention.

First, a two-dimensional flat image is formed on the recording medium WK (S102). The flat image is an image formed by a combination of the process color inks and the white color ink. The controller 130 moves the recording head unit 120 laterally while moving the recording medium WK forward. The recording medium WK is moved via the feed motor 103. The movement of the recording head unit 120 is achieved by controlling the scan motor 109. While the recording head unit 120 is moving laterally, the recording heads 122*a* or the recording head 122*c* eject the ink and the ejected ink adheres to the recording medium WK. Additionally, while the recording head unit 120 is moving laterally, the first emitting device 11 or the second emitting device 12 emits ultraviolet rays. In this embodiment, both the first emitting device 11 and the second emitting device 12 emit ultraviolet rays to cure the ink.

The term "curing" refers to the process of the liquid ink hardening in response to the emitted light. In this embodiment, the ink is sufficiently hardened as to not yield under a certain amount of pressure, such as the pressure of a finger. The expression "while moving the recording medium WK forward" refers to moving the recording medium WK forward by a prescribed feed amount every time the recording head unit 120 laterally reciprocates, or may refer to moving the recording medium WK forward by a prescribed feed amount every time the recording head unit 120 laterally moves from one side to the other. Alternatively, "while moving the recording medium WK forward" may refer to continuously or intermittently moving the recording medium WK forward while the recording head unit 120 is moving. In other words, the recording medium WK may be moved when the recording head unit 120 is stationary or when the recording head unit 120 is moving. Furthermore, ink may be ejected from the recording head unit 120 while the recording head is moving and when the recording medium WK is either moving or stationary.

Next, the controller 130 retracts the recording medium WK (S104). The retraction of the recording medium WK is a process of moving the recording medium WK backward until it returns to the initial position. In this example, the initial position is the same as the initial position for image formation in step S102. However, the initial position of the recording medium WK and the initial position of step S102 may be different.

Once the recording medium WK returns to the initial position, the controller 130 then performs three-dimensional printing using the clear ink (S106, S108, and S110). The three-dimensional printing is performed via the first and second printing operations. The first control part 130*a* of the controller 130 performs the first printing operation (S106). During the first printing operation, the ejected clear ink is cured before a prescribed time period. For example, the prescribed time period may be five seconds. Additionally, according to the current example, timing of the prescribed time period begins when the ink is ejected from the recording heat unit 120.

The first control part 130*a* moves the recording head unit 120 laterally while moving the recording medium WK forward. While the recording head unit 120 is moving laterally, the recording head 122*b* ejects the clear ink and the first emitting device 11 and the second emitting device 12 emit ultraviolet rays. Specifically, the recording head 122*b* ejects the clear ink both when the recording head unit 120 is moving to the left and when moving to the right.

The clear ink is immediately cured upon adhesion to the recording medium WK to form a hardened layer of the ink. In the first printing operation, ejection and curing of the clear ink may be performed more than once and a plurality of hardened layers may be stacked on the recording medium WK. The term "performed more than once" refers to the recording head unit 120 moving back and forth in the main scanning direction while the recording head 122*b* ejects the ink. In other words, the recording head unit 120 performs bidirectional printing. When the recording head 122*b* only ejects the ink when the recording head unit 120 is moving to the left or when moving to the right, the recording head unit 120 performs unidirectional printing.

The recording head 122*b* ejects the clear ink on a formed hardened layer. The first emitting device 11 and the second emitting device 12 cure the ink on the hardened layer. FIGS. 5A to 6C illustrate the hardened layers formed by the first printing operation.

Figure 5:
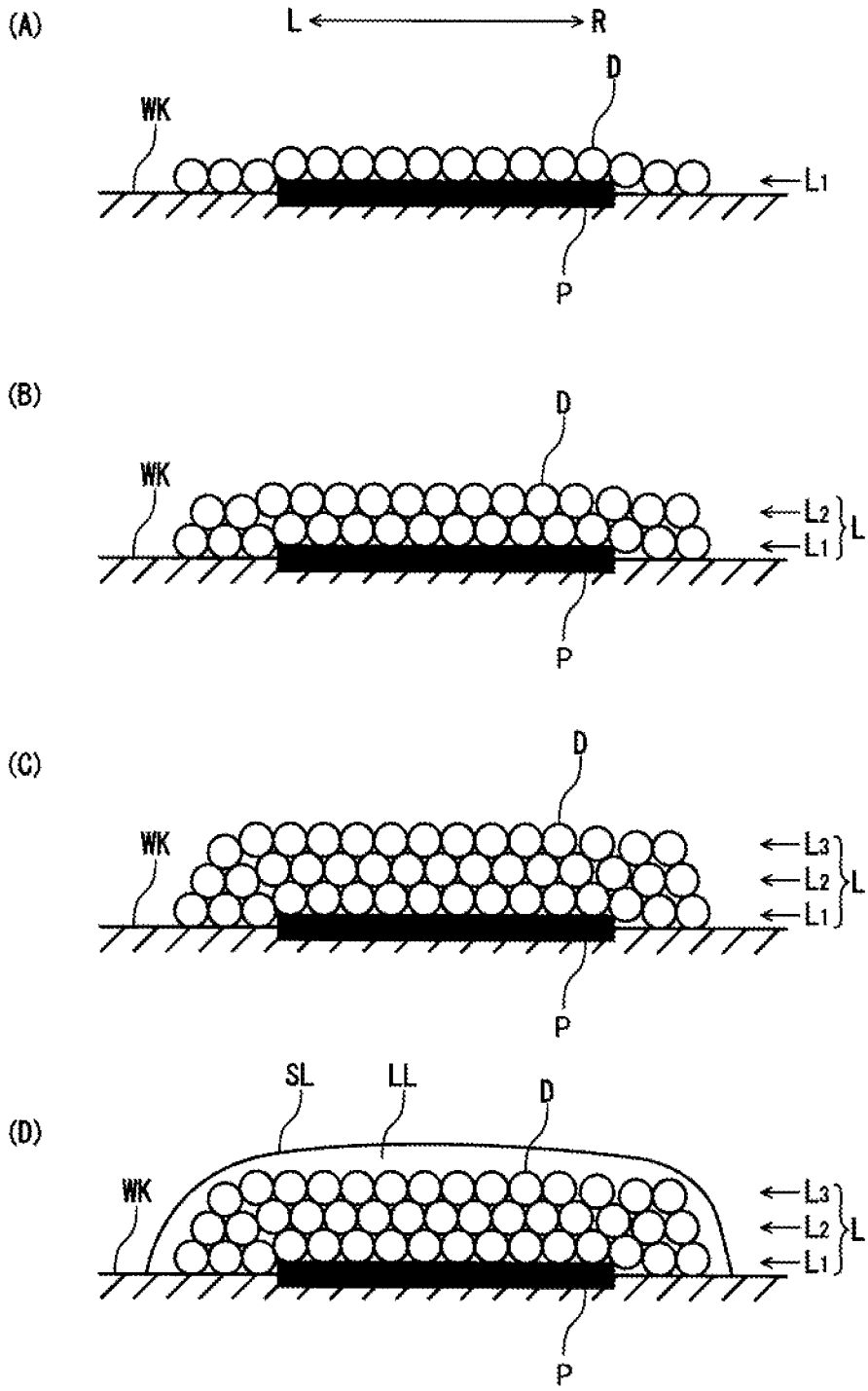
FIGS. 5A to 5D illustrate a surface of a recording medium during the process of three-dimensional printing according to an embodiment of the present invention.

Referring to FIG. 5, the symbol P represents the image formed in step S102 (FIG. 4), and the symbol D represents a cured clear ink droplet. In the first printing operation, the ejected clear ink is immediately irradiated with ultraviolet rays from the first emitting device 11. For example, in the first printing operation, the ink ejected from the recording head 122*b* is irradiated with ultraviolet rays approximately two seconds after the ejection during a process in which the recording head unit 120 moves to the right. The two second time period is used as an example and the curing time may be more or less than two seconds. Accordingly, the clear ink is cured before spreading to the peripheral region. Specifically, the clear ink is cured before the elapse of the prescribed time period after the ejection from the recording head 122*b*.

The clear ink is cured in the form of particles, in other words, the clear ink droplets are cured before combining with each other into a unitary body. The clear ink droplets are cured independently from each other, such that, the resulting hardened layer has a highly uneven low-gloss matte surface.

As illustrated in FIG. 5, a second hardened layer L2 is formed on a first hardened layer L1, and a third hardened layer L3 is formed on the second hardened layer L2. The number of the hardened layers is not limited to the layers illustrated in FIG. 5. The number of the hardened layers may be set by the user or may be pre-set. In the following example, the stack of the first hardened layer L1, second hardened layer L2, and third hardened layer L3 is referred to as hardened layer L.

In this embodiment, the first hardened layer L1, the second hardened layer L2, and the third hardened layer L3 are formed when the recording medium WK is stationary. Specifically, in order to form the first hardened layer L1, the second hardened layer L2, and the third hardened layer L3, the first control part 130*a* repeats the ejection of clear ink and emission of ultraviolet rays three times. Accordingly, the recording head unit 120 reciprocates one and a half times in bi-direction printing without the recording medium WK being moved. The ejection of clear ink and emission of ultraviolet rays is not limited to three times and may be changed based on the required thickness of the hardened layer L. After the third hardened layer L3 is formed, the recording medium WK is moved forward by a prescribed feed amount J and the above procedure is repeated. As a result, the first hardened layer L1, second hardened layer L2, and third hardened layer L3 are formed over the entire image P.

Additionally, the recording head unit 120 may move after forming each hardened layer L1, L2, and L3. For example, after forming the first hardened layer L1, the recording head unit 120 may be moved or remain stationary to eject ink on the first hardened layer L1 to form the second hardened layer L2. Furthermore, after forming the second hardened layer L2, the recording head unit 120 may be moved or remain stationary to eject ink on the second hardened layer L2 to form the third hardened layer L3. Accordingly, the aforementioned process forms the hardened layers L1, L2, L3 in a shape, such as a concave shape.

The method for moving the recording medium WK is not specifically limited as long as at least one hardened lay may be formed on the recording medium WK. For example, the feed amount of the recording medium WK may be one-third of the feed amount J (J/3) and the ejection and curing of clear ink may be performed every time the recording medium WK is moved by the feed amount J/3.

Figure 6:
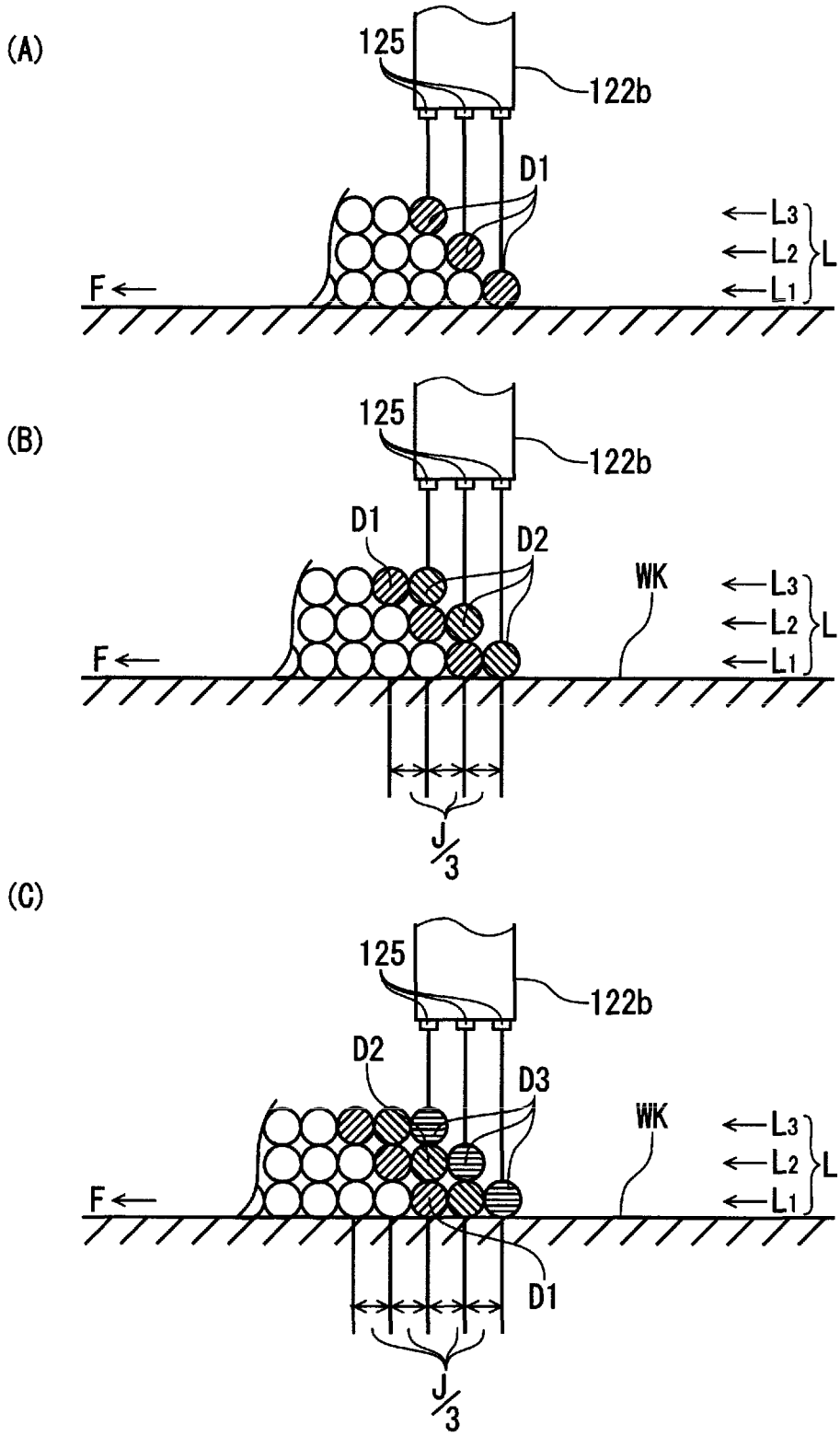
FIGS. 6A to 6C illustrate a surface of the recording medium during the process of three-dimensional printing according to an embodiment of the present invention.

For example, after clear ink droplets D1 are ejected and cured as illustrated in FIG. 6A, the recording medium WK is conveyed by J/3 and clear ink droplets D2 are ejected and cured (FIG. 6B). The recording medium WK may then be moved by another J/3, and clear ink droplets D3 are ejected and cured (FIG. 6C). It should be noted that in the example illustrated in FIG. 6, the recording head 122*b* has three nozzles 125 arranged longitudinally. The hatched clear ink droplets D1, D2, and D3 are clear ink droplets ejected at the times illustrated in FIGS. 6A to 6C, respectively. The first hardened layer L1, second hardened layer L2, and third hardened layer L3 can also be formed by the method described above.

In this example, the feed amount of the first printing operation is one-third the feed amount in the second printing operation. The term "feed amount" refers to the amount by which the recording medium WK is moved at one time. The ejection and curing of clear ink is not necessarily performed when the recording medium WK is kept stationary and may be performed when the recording medium WK is being moved in a direction.

When the first printing operation is completed, the control part 130*c* of the controller 130 retracts the recording medium WK (S108). The process in step S108 is the same as that in step S104. Therefore, description of step S108 is omitted. As a result of step S108, the recording medium WK is returned to the initial position.

Next, the second control part 130*b* of the controller 130 performs the second printing operation (S110). In the second printing operation, the ejected clear ink is cured after the prescribed time period after ejection of the clear ink from the recording head 122*b*. Specifically, in the second printing operation, the clear ink ejected from the recording head 122*b* is cured after a period of time which is greater than the time taken to cure the clear ink in the first printing operation.

The second control part 130*b* moves the recording head unit 120 laterally while moving the recording medium WK forward. While the recording head 122*b* is moving laterally, the recording head 122*b* ejects the clear ink on the hardened layer L and the second emitting device 12 emits ultraviolet rays. Specifically, the recording head 122*b* ejects the clear ink when the recording head unit 120 is moving to the left and to the right. During the second printing operation, the first emitting device 11 is off and does not emit ultraviolet rays. The clear ink ejected on the hardened layer L is cured by the second emitting device 12 after the recording medium WK is moved forward by the prescribed feed amount J.

In the second printing operation, the clear ink is cured later than in the first printing operation. Thus, the clear ink is cured after spreading to the peripheral region. In other words, the clear ink droplets are cured after combining with each other into a generally unitary body. Therefore, a hardened layer LL with a less uneven surface SL is formed (FIG. 5D). The surface SL is a surface with a high-gloss, which is referred to as a glossy surface.

The recording medium WK is moved forward by the prescribed feed amount J every time the recording head unit 120 is moved to the left or right once, that is, the recording head unit 120 reciprocates 0.5 times, and the second printing operation is repeated. In the second printing operation, the number of times the recording head unit 120 reciprocates while the recording medium WK is moved by the feed amount J is not limited to 0.5 times. It may be changed, depending on the required thickness of the hardened layer LL.

The hardened layer LL formed by the second printing operation has a glossy surface SL, whereas the hardened layer L3 underneath has a matte surface. However, even if the hardened layer L3 has a matte surface, the image I can look glossy if the hardened layer LL covering the hardened layer L3 has a glossy surface SL.

Figure 7:
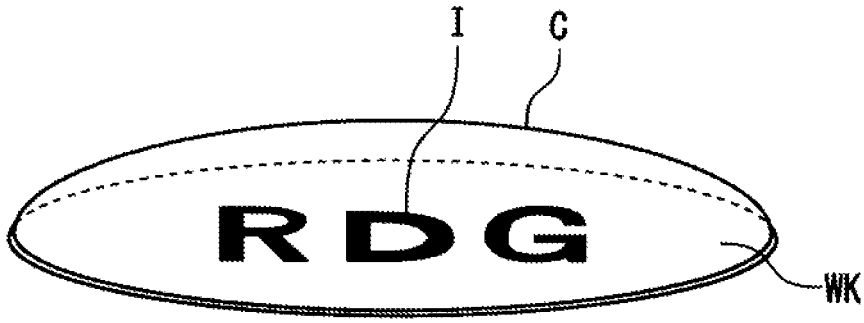
FIG. 7 illustrates a three-dimensional image according to an embodiment of the present invention.

The controller 130 finishes the three-dimensional printing when step S110 is completed. A glossy concave coating layer C is formed over the image I on the recording medium WK as a result of the three-dimensional printing (FIG. 7).

As described above, the ejection and curing of clear ink is performed a plurality of times in the first printing operation to form a plurality of hardened layers, such as the first hardened layer L1, second hardened layer L2, and third hardened layer L3. Because the recording medium WK is not retracted when each of the hardened layers L1, L2, and L3 are formed, the time necessary to form a three-dimensional image can be shortened. In addition, errors in forming the hardened layers L1, L2, and L3 do not tend to occur. Accordingly, a high-quality glossy three-dimensional image can be quickly formed.

In the first printing operation, the clear ink that has adhered to the recording medium WK or the hardened layer is cured before spreading to the peripheral region. Additionally, the clear ink droplets are maintained in a relatively granular state when cured. Therefore, the thickness of the hardened layer L can be sufficiently large with a relatively small amount of ink.

In this embodiment, the hardened layer L formed by the first printing operation has a larger thickness than the hardened layer LL formed by the second printing operation. The thickness of the hardened layer L formed by the first printing operation can be adjusted as needed by adjusting the number of times the ink is ejected and cured during the first printing operation. Therefore, the thickness of a three-dimensional image can be easily adjusted. Additionally, the hardened layer L formed by the first printing operation may have a thickness which is less than the hardened layer LL formed by the second printing operation.

In the current embodiment, the number of times in which the ink is ejected and cured per the prescribed feed amount of the recording medium WK is greater in the first printing operation in comparison to the second printing operation. Thus, the three-dimensional image is formed more efficiently in the first printing operation.

In the current embodiment, the hardened layer LL formed by the second printing operation covers the hardened layer L formed by the first printing operation (FIG. 5D). Specifically, the print area on the recording medium WK in the second printing operation is wider than that in the first printing operation. This makes it possible to obtain a high-quality glossy image. In addition, it is possible to form a hardened layer L bulging upward on only a part of the recording medium WK while covering the entire surface of the recording medium WK with a layer having a glossy surface SL since the print area on the recording medium WK in the second printing operation is wider than that in the first printing operation.

In the current embodiment, the period of time before the emission of ultraviolet rays after the ejection of the clear ink in the second printing operation is greater than that in the first printing operation. This enables the hardened layer LL formed by the second printing operation to have a smoother surface than the hardened layer L formed by the first printing operation. Accordingly, the surface conditions of the hardened layer LL and the hardened layer L can be controlled. However, the method for making the time taken for the ejected ink to cure in the second printing operation greater than the time taken for the ejected ink to cure in the first printing operation is not specifically limited to a particular method.

For example, the time taken for the clear ink to cure can be controlled by adjusting the period of time for which ultraviolet rays are emitted. In addition, the intensity of the ultraviolet rays in the first printing operation may be stronger than the intensity of the second printing operation. Such a method can be implemented by, for example, providing the first emitting device 11 with a larger number of light emitting elements in comparison to the second emitting device 12. Alternatively, such a method can be implemented by adjusting the number of light emitting elements of the emitting devices 11 and 12 to be illuminated.

Moreover, according to another embodiment, in order for the period of time for the emission of ultraviolet rays after the ejection of the clear ink to be greater in the second printing operation than the period of time in the first printing operation, it is necessary that the period for the recording head 122*b* ejecting the ink when moving to the left and to the right to be greater in the first printing operation in comparison to the second printing operation.

In the first and second printing operations, the quality of the three-dimensional image can be further improved if the recording medium WK is kept stationary while the recording head unit 120 moves to eject and cure the ink. Thus, the recording medium WK may be moved when the recording head unit 120 stops ejecting the ink to change the moving direction along the main scanning direction.

As described above, in the second printing operation, ink is ejected on ink which has already been ejected and cured in the first printing operation. With regard to the ink which is ejected on the cured ink, the later ejected ink is not necessarily ejected at exactly the same position as the ink which was previously ejected. Since the recording medium WK is moved in a forward or reverse direction, a portion of the later ejected ink may be ejected at a slightly different position from the previously ejected ink (FIG. 5C).

Step S102 and step S104 form an image I on the recording medium WK. However, these steps may be omitted. The image I may have been formed in advance on the recording medium WK. In other words, the inkjet printer 100 may be used to apply the clear ink to a recording medium WK on which an image I has been already formed.

In the embodiment described above, a three-dimensional image is formed by stacking clear ink layers. However, a three-dimensional image may be formed by stacking layers of process color inks Specifically, the first and second printing operation discussed above may be performed using inks other than the clear ink.

The ink ejected in the first printing operation and the ink ejected in the second printing operation may be of the same type or different types. For example, a process color ink or white ink may be used in the first printing operation whereas a clear ink may be used in the second printing operation. In this case, a hardened layer of a glossy clear ink is formed over a matte hardened layer formed of a process color ink or white ink.

In the embodiment described above, the second emitting device 12 is located in front of the recording head group 122. This allows sufficient time between the ejection of ink and the emission of ultraviolet rays in the second printing operation. However, as long as there is sufficient time for the ejected ink droplets to combine with each other into a unitary body, the position of the second emitting device 12 is not specifically limited to a particular location.

In addition, the first emitting device 11 may be used without the use of the second emitting device 12 in the second printing operation. Specifically, after the ejection of the clear ink from the recording head 122*b*, the first emitting device 11 may be configured to emit ultraviolet rays after a period of time which is greater than a period of time of the first printing operation. In this case, the three-dimensional printing can be achieved without the use of the second emitting device 12.

In the embodiment described above, the inner region of the three-dimensional image is formed to have a matte surface and the surface region of the three-dimensional image is formed to have a glossy surface in order to form a transparent glossy three-dimensional image. Alternatively, the entire three-dimensional image may be formed of layers with a glossy surface.

For example, the recording head unit 120 is moved laterally with the recording medium WK kept stationary and the clear ink is ejected from the recording head 122*b*. Then, after the ejected clear ink droplets combine with each other into a unitary body, the recording head unit 120 is moved laterally and ultraviolet rays are emitted from the first emitting device 11. Thereafter, the procedure is repeated. A glossy three-dimensional image can also be formed by stacking glossy hardened layers as described above. In this example, the second printing operation is unnecessary.

The inkjet printer 100 can form a matte three-dimensional image. In this example, only the first printing operation is performed, and the retraction of the recording medium WK (S108) and the second printing operation (S110) are not required.

In the embodiment described above, a potting process is performed to form a lens-shaped, transparent glossy three-dimensional image. The potting process is a process for forming a three-dimensional image bulging out from a surface of a recording medium WK by stacking flat images on the recording medium WK. However, the shape of the three-dimensional image is not necessarily limited to the lens shape and may be any three-dimensional image.

For example, an image including letters or symbols bulging out from the recording medium WK may be formed or a group of projections such as Braille dots or embossed patterns may be formed. In this example, the three-dimensional image is not necessarily formed with the clear ink and may be formed with process color inks or a white ink.

In the embodiments described above, inks which cure upon exposure to ultraviolet light is used, however, inks which cure in response to a certain physical action after adhering to the recording medium WK may also be used. For example, inks which cure in response to application of heat, absorption of heat, or cooling may be used. In this example, a heating device for applying heat or a cooling device may be used instead of the first emitting device 11 and the second emitting device 12.

In addition, in the embodiments described above, the recording head unit 120 is configured to reciprocate in the main scanning direction. However, the configuration of the recording head unit 120 is not limited to that shown in the present embodiments and can comprise any configuration as long as it can eject ink along primary scanning lines on the recording medium WK. For example, an in-line recording head in which nozzles are arranged in the main scanning direction may be used as the recording head.

An inkjet printer 100 according to another embodiment can perform printing in at least the three print modes described below.

A first print mode refers to a mode in which a highly uneven print surface is formed. When the first print mode is selected, a matte image can be obtained.

A second print mode refers to a mode in which a less uneven print surface is formed. When the second print mode is selected, a glossy image can be obtained.

A third print mode refers to a mode in which the three-dimensional printing is performed. When the third print mode is selected, a glossy three-dimensional image can be obtained.

Figure 8:
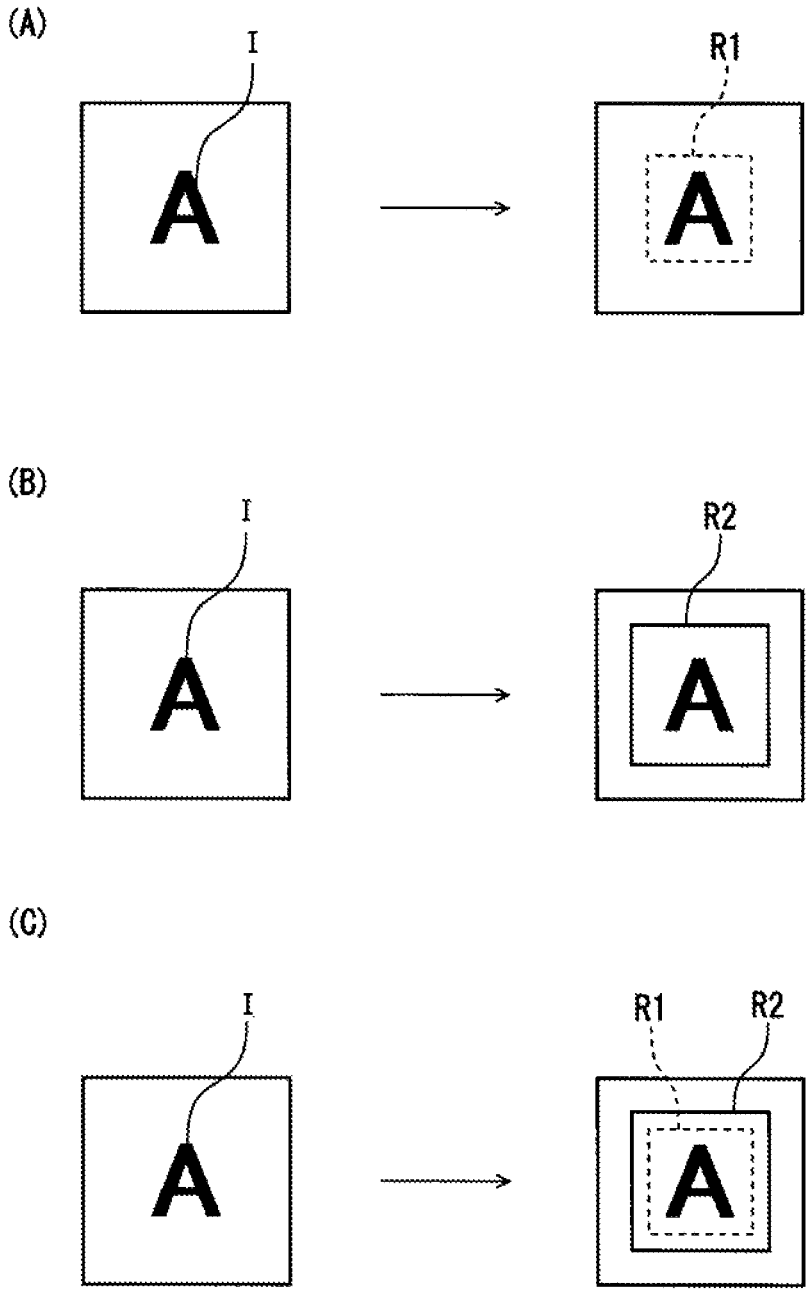
FIGS. 8A to 8C illustrate print areas according to embodiments of the present invention.

As in the previous embodiments, the controller 130 includes a first control part 130*a* for matte printing and a second control part 130*b* for glossy printing. The controller 130 automatically creates data for the clear ink necessary to cover the image I on the recording medium WK. Specifically, the first control part 130*a* creates data of an area R1 necessary to cover the image I with matte clear ink as shown in FIG. 8A. The second control part creates data of an area R2 necessary to cover the image I with glossy clear ink as shown in FIG. 8B. The sizes of the area R1 and area R2 may be either the same or different.

When the first print mode is selected, the first control part 130*a* performs the first printing operation as previously described in the area R1. Accordingly, a layer of clear ink with a matte surface is formed over the image I. On the other hand, when the second print mode is selected, the second control part 130*b* performs the second printing operation as previously described in the area R2. Thus, a layer of clear ink with a glossy surface is formed over the image I. When the third print mode is selected, the same procedures as those disclosed in steps S106, S108, and S110 are performed.

Specifically, the first control part 130*a* performs the first printing operation in the area R1. Next, the control part 130*c* retracts the recording medium WK backward. Then, the second control part 130*b* performs the second printing operation in the area R2. Accordingly, a glossy layer of the clear ink bulging from the surface is formed over the image I.

When the third print mode is executed, the data of the area R1, for use in the first print mode, and the data of the area R2, for use in the second print mode, are used in common. The inkjet printer 100 according to the current embodiment can reduce the required amount of data.

A computer program according to each of the above embodiments instructs the controller 130 of the inkjet printer 100 to perform the control functions as previously described. However, the external computer 133 may perform other functions of the controller 130. In this example, the computer program instructs the controller 130 and the computer 133 to perform the control functions as previously described. The computer program may be sent or received via a communication network such as the Internet. Alternatively, the computer program may be stored in a storage medium such as CD-R, hard disk or USB memory. The present invention includes a computer readable storage medium.

The invention claimed is:

1. An inkjet recording apparatus, comprising:

a recording head configured to eject an ink on a recording medium;

an ink curing device configured to cure the ink ejected on the recording medium;

a moving device configured to move the recording medium in a first direction and a second direction opposite to the first direction; and a control device configured to control the recording head, the ink curing device, and the moving device, the control device comprising:

a first control part configured to perform a first printing operation comprising ejecting the ink from the recording head while moving the recording medium in the first direction, and curing the ink ejected from the recording head before a prescribed period of time, and repeating the ejecting and curing of the ink such that the ink can be ejected on the cured ejected ink, a second control part configured to control movement of the recording medium in the second direction after the completion of the first printing operation, and a third control part configured to perform, after the recording medium has been moved in the second direction, a second printing operation comprising ejecting and curing the ink on the cured ink from the first printing operation, after the prescribed period of time.

2. The inkjet recording apparatus according to claim 1, wherein the first control part and the third control part control the recording head such that the first printing operation forms a layer of the ink which is thicker than a layer of the ink formed by the second printing operation.

3. The inkjet recording apparatus according to claim 1, wherein the first control part and the third control part control the moving device such that the recording medium is moved by a feed amount during the first operation which is less than a feed amount of the second printing operation.

4. The inkjet recording apparatus according to claim 1, wherein the first control part and the third control part control the moving device and the recording head such that the second printing operation forms a print area on the recording medium which is greater than a print area of the first printing operation.

5. The inkjet recording apparatus according to claim 1, wherein the ink cures upon exposure to ultraviolet rays, and the ink curing device emits the ultraviolet rays.

6. The inkjet recording apparatus according to claim 1, wherein the first control part and the third control part control the emitting device such that the period of time before the ink is irradiated with ultraviolet rays after the ink has been ejected is greater in the second printing operation in comparison to the first printing operation.

7. The inkjet recording apparatus according to claim 1, wherein the first control part and the third control part control the recording head such that the number of times the ink is ejected and cured per a prescribed feed amount by which the recording medium is moved is greater in the first printing operation in comparison to the second printing operation.

8. The inkjet recording apparatus according to claim 1, wherein the ink is a clear ink.

9. The inkjet recording apparatus according to claim 8, further comprising an additional recording head for ejecting a chromatic color ink, wherein the control device forms an image on the recording medium by ejecting the chromatic color ink onto the recording medium from the additional recording head prior to the first printing operation, and wherein the first control part controls the clear ink to be ejected over the formed image.

10. The inkjet recording apparatus according to claim 1, further comprising a guide rail extending perpendicular to the first direction, and a moving mechanism for moving the recording head along the guide rail, wherein the first control part and the third control part instruct the recording head to eject the ink without moving the recording medium while moving the recording head in the first printing operation and the second printing operation.

11. The inkjet recording apparatus according to claim 1, further comprising a guide rail extending in a scanning direction perpendicular to the first direction, and a moving mechanism for moving the recording head along the guide rail, wherein the ink curing device has a first curing device disposed on one side of the recording head and movable with the recording head, and a second curing device disposed on a side opposite the one side of the first curing device, offset in the first direction with respect to the recording head, and movable with the recording head.

12. The inkjet recording apparatus according to claim 1, wherein the first control part performs the first printing operation such that the ink has a concave shape when cured.

13. An inkjet recording apparatus comprising:

a recording head configured to eject an ink on a recording medium;

an ink curing device configured to cure the ink ejected on the recording medium;

a moving device configured to move the recording medium in a first direction and a second direction opposite to the first direction; and a computer configured to control the recording head, the ink curing device, and the moving device, wherein a computer program configured to control the computer of the inkjet recording apparatus comprises:

a first control means configured to perform a first printing operation comprising ejecting the ink from the recording head while moving the recording medium in the first direction, and curing the ink ejected from the recording head before a prescribed period of time, a second control means configured to control movement of the recording medium in the second direction after the completion of the first printing operation, and a third control means configured to perform, after the recording medium has been moved in the second direction, a second printing operation comprising ejecting and curing the ink on the cured ink from the first printing operation, after the prescribed period of time.

14. An inkjet recording apparatus, comprising:

a recording head configured to eject an ink on a recording medium;

an ink curing device configured to cure the ink ejected on the recording medium;

a moving device configured to move the recording medium in a first direction and a second direction opposite to the first direction; and a control device configured to control the recording head, the ink curing device, and the moving device, the control device comprising:

a first control part configured to perform a first printing operation comprising ejecting and curing the ink while moving the recording medium in the first direction, a second control part configured to control movement of the recording medium in the second direction after the completion of the first printing operation, and a third control part configured to perform, after the recording medium has been moved in the second direction, a second printing operation comprising curing and ejecting the ink on the cured ink of the first printing operation.

* * * * *